US006313747B2

(12) United States Patent
Imaichi et al.

(10) Patent No.: US 6,313,747 B2
(45) Date of Patent: Nov. 6, 2001

(54) RESONANT TAG

(75) Inventors: Hideaki Imaichi, Fujisawa; Takeshi Matsumoto, Samukawa-machi, both of (JP); Gary Thomas Mazoki, Sewell; Anthony Frank Piccoli, Audubon, both of NJ (US)

(73) Assignee: Checkpoint Manufacturing Japan Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/732,312

(22) Filed: Dec. 7, 2000

(30) Foreign Application Priority Data

Dec. 8, 1999 (JP) ..... 11-348270

(51) Int. Cl.[7] ..... G08B 13/14

(52) U.S. Cl. ..... 340/572.5; 340/572.3; 340/572.7; 29/602.1; 29/25.42; 29/832; 361/765; 361/777

(58) Field of Search ..... 340/572.3, 572.5, 340/572.1, 572.2, 572.7; 29/25.42, 602.1, 848, 832, 593; 361/777, 765; 324/675; 333/167; 428/209; 343/895; 156/60, 272.2; 336/105; 257/531

(56) References Cited

U.S. PATENT DOCUMENTS 4,369,557 * 1/1983 Vandebult ..... 29/25.42
5,276,431 * 1/1994 Piccoli et al. ..... 340/572.3
5,442,334 * 8/1995 Gallo et al. ..... 340/572.3
5,510,769 * 4/1996 Kajfez et al. ..... 340/572.5
5,574,431 * 11/1996 McKeown et al. ..... 340/572.3
5,695,860 * 12/1997 Imaichi et al. ..... 428/209
5,734,327 * 3/1998 Batterink et al. ..... 340/572.5
5,754,110 * 5/1998 Appalucci et al. ..... 340/572.5
5,841,350 * 11/1998 Appalucci et al. ..... 340/572.3
6,087,940 * 7/2000 Caperna et al. ..... 340/572.5
6,091,607 * 7/2000 McKeown et al. ..... 361/777
6,133,834 * 10/2000 Eberth et al. ..... 340/572.5
6,169,482 * 1/2001 Altwasser et al. ..... 340/572.3

* cited by examiner

*Primary Examiner*—Benjamin C. Lee
(74) *Attorney, Agent, or Firm*—Knobbe, Martens, Olson & Bear, LLP

(57) ABSTRACT

The invention relates to a resonant tag including an insulating thin film and coiled circuits made of a metal foil respectively formed on both sides of the insulating thin film. The coiled circuits are formed in an electrically connected relation to each other with a space at the center of the insulating thin film. Said both coils are almost superimposed on each other to form a capacitor, thereby constituting an LC circuit. The area of a portion of each side of the thin film, said portion being surrounded by the innermost peripheries of both coils and having no metal foil on both sides, is controlled to at least 16% based on the whole area of said one side of the tag, whereby a resonant tag having an area of at most 700 $mm^2$ can be obtained.

21 Claims, 5 Drawing Sheets

RESONANT TAG

BACKGROUND OF THE INVENTION

1. Field of the Invention

The present invention relates to resonant tags used in the prevention of shoplifting, and the like. More particularly, the present invention relates to resonant tags capable of being attached to small-sized products because of their small size.

2. Description of the Background Art

A monitoring system composed of a combination of a tag, which resonates with a wave of a radio frequency, with transmitting and receiving antennas has heretofore been used in retail stores, libraries, etc. for the purpose of preventing shoplifting. The resonant tag has a structure that a coil and a plate are formed with an electroconductive metal foil on one side of an insulating film, another plate is formed on the other side thereof, and an LC circuit is constituted as a whole, and resonates with a wave of a specific radio frequency. If a product attached with this tag passes through a monitoring region without effecting checking, it resonates with the radio-frequency wave transmitted from the transmitting antenna, and the receiving antenna detects this resonance to give an alarm. As the resonant frequency, a frequency of 5 to 15 MHz is generally adopted for reasons of easy distinction from various noise frequencies.

The conventional resonant tags are in the form of a rectangle of 32 mm×35 mm in demensions even in the smallest and are considerably large, and so such a tag has been hard to be attached to small-sized cosmetics such as lipsticks, jewelry, and the like. The reason for it is that a circuit, which resonates with a wave of 5 to 15 MHz and has a sufficient gain and dimensions desired for the market, has been unable to be formed.

On the other hand, EPO 142380A2 discloses a resonant tag in which a circuit has been formed on each side. This tag has substantially the same patterns on both sides of a dielectric film, said patterns having been formed in a coil turned reversely to each other when viewed from the same direction and almost superimposed on each other. When the circuits are formed on both sides in such a manner, not only the number of the spiral coils is doubled, but also a capacitor is formed between the coiled portions on the front and back sides of the film, said coiled portions being superimposed on each other. Therefore, there is no need to form a separate capacitor portion. However, even in this tag, the dimensions thereof cannot be reduced smaller than a certain size. More specifically, the mere formation of the circuits on both sides cannot provide a smaller-sized resonant tag having sufficient resonance property.

SUMMARY OF THE INVENTION

It is an object of the present invention to provide a small-sized resonant tag used in a detection system serving for the prevention of shoplifting, and the like making good use of a wave of a radio frequency, particularly, a resonant tag in the form of a rectangle (including a square) the dimensions of which are at most 25 mm×28 mm, preferably at most 23 mm×26 mm.

The present inventors have carried out an extensive investigation as to the miniaturization of resonant tags. As a result, it has been found that when a coiled circuit is formed on each side of an insulating film, the thickness of the insulating film and the proportion of an opening part located in the center of each coiled circuit greatly influence the resonant property of the resulting resonant tag, thus leading in the completion of the present invention.

According to the present invention, there is thus provided a resonant tag comprising an insulating thin film having a thickness of 10 to 30 $\mu$m, and coiled circuits made of a metal foil respectively formed on both sides of the insulating thin film, wherein the coiled circuits are formed in an electrically connected relation to each other with a space at the center of the insulating thin film, said both coils are formed taking turns in reverse directions to each other when viewed from the same direction and almost superimposed on each other except portions that cannot be superimposed on each other because the turning directions of the coils are reversed with the exception of the outermost peripheries when viewed from a direction perpendicular to the thin film, thereby forming a capacitor to constitute an LC circuit, the widths of portions of said both circuits, which correspond to each other, are almost equal except the outermost peripheries, the area of a portion of each side of the thin film, said portion being surrounded by the innermost peripheries of both coils and having no metal foil on both sides, is at least 16% based on the whole area of said one side of the tag, a thin-wall part where the thickness of its corresponding insulating film portion is thinner than that of its remaining portion is formed in part of the portions where said both circuits are superimposed on each other, the resonant tag resonates with a wave of the predetermined radio frequency and undergoes dielectric breakdown at the thin-wall part when applying the prescribed voltage or higher voltage to the tag, whereby the resonant tag can be prevented from resonating with the wave of said radio frequency, and the resonant tag has an area of at most 700 mm$^2$.

According to the present invention, there is also provided an apparatus for detecting products, which comprises a pair of antennas respectively transmitting and receiving a wave of a radio frequency, and the resonant tag described above.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE PREFERRED EMBODIMENTS

Figure 1:
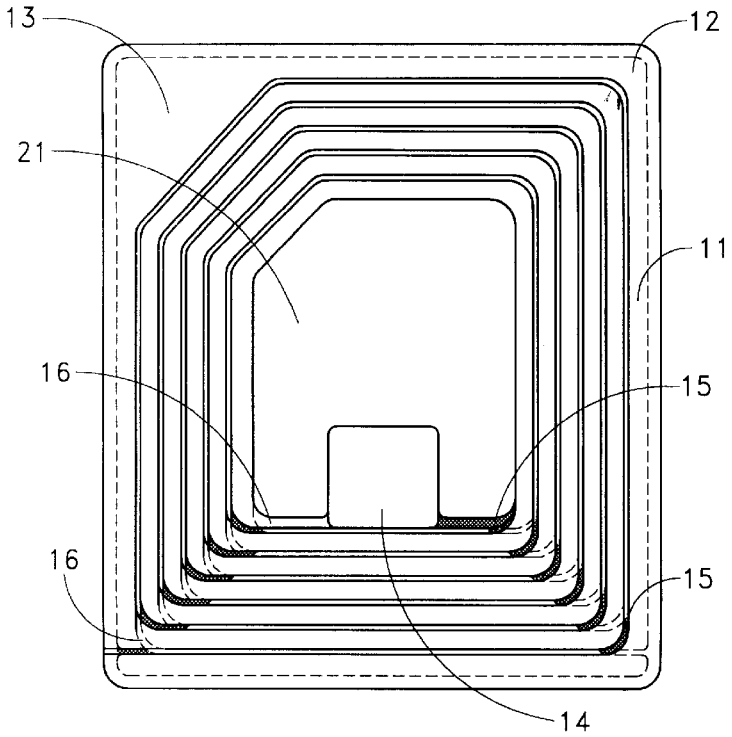
FIG. 1 illustrates a resonant tag according to the present invention as viewed from its one side.

The present invention will hereinafter be described in detail.

The greatest feature of the resonant tags according to the present invention resides in their size. As described above, the smallest size in the conventional resonant tags has been 32 mm×35 mm (1120 $mm^2$). In the present invention, resonant tags of at most 700 $mm^2$ smaller than that can be provided. Preferably, there can also be provided resonant tags which are in the form of a rectangle (including a square) of at most 25 mm×28 mm, more preferably at most 23 mm×26 mm in external dimensions.

The resonant tags according to the present invention are formed by respectively forming circuits on both sides of an insulating film having a thickness of about 10 to 30 $\mu$m, preferably 15 to 20 $\mu$m. As the insulating film, is used, for example, a film of a polyolefin such as polyethylene, polypropylene or ionomer, polystyrene, polyester, an ethylene-methacrylic acid copolymer, or the like. Of these, polyethylene is preferred from the viewpoints of dielectric constant, dielectric loss and processability.

In the circuits, is used a metal excellent in electrical conductivity, for example, a copper foil or aluminum foil. The aluminum foil is preferred from the viewpoints of economy and the like. The thickness of the metal foil is preferably 30 to 80 $\mu$m, more preferably 50 to 60 $\mu$m from the viewpoints of the performance of the resulting tag, processability, economy, etc.

Figure 2:
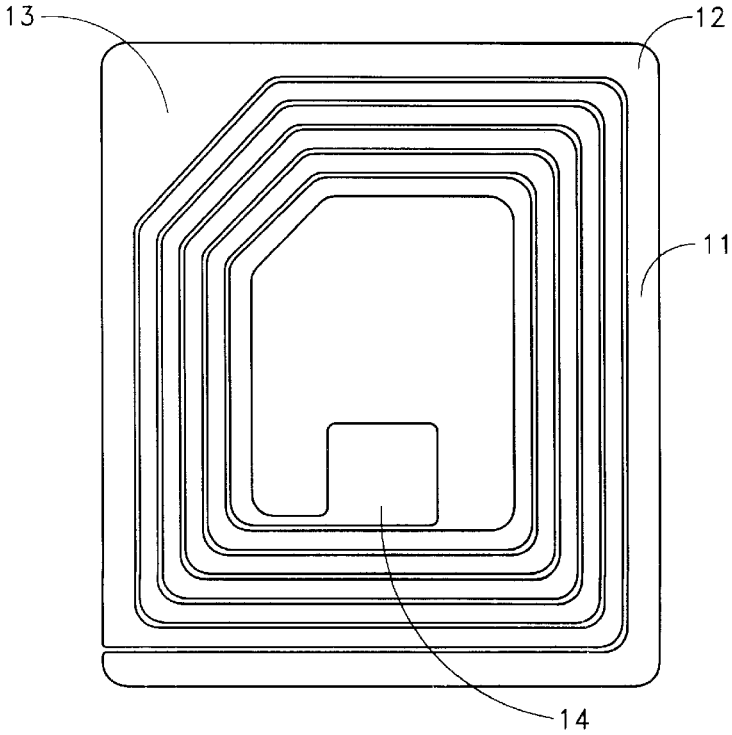
FIG. 2 illustrates a circuit pattern on one side of the resonant tag shown in FIG. 1.
Figure 3:
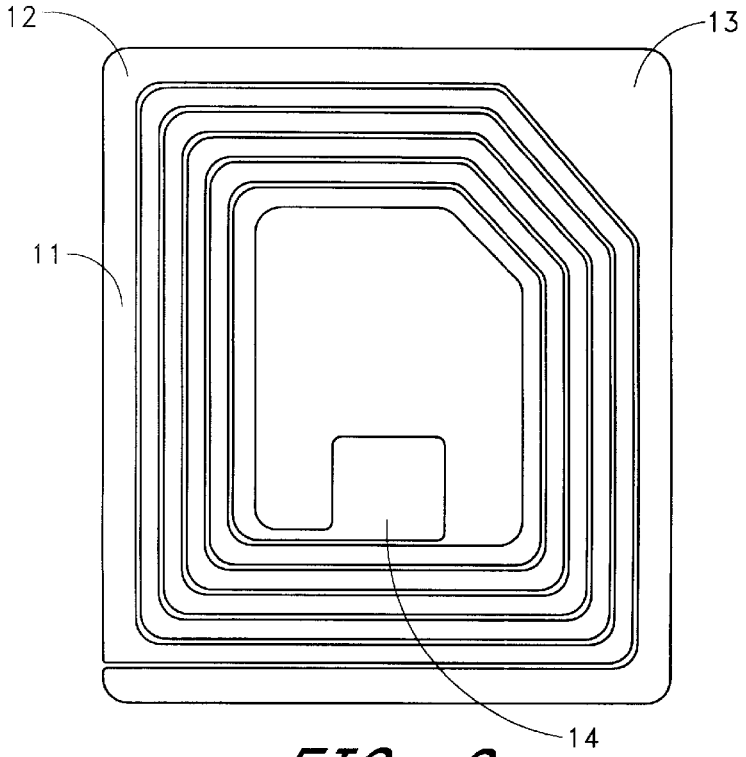
FIG. 3 illustrates a circuit pattern on the other side of the resonant tag shown in FIG. 1.

In the resonant tags according to the present invention, coiled circuits are respectively formed on both sides of the insulating film with a space at the center of the insulating film. Examples of circuit patterns are illustrated in FIGS. 1 to 3. FIGS. 2 and 3 illustrate patterns respectively formed on the front and back sides of the insulating film. FIG. 1 illustrates a resonant tag, in which such patterns have been formed on both sides, as viewed from the front side. In FIGS. 1 to 3, the coils are formed of linear portions 11 and curved portions 12 for connecting the linear portions to each other. In each coil, a triangular plate portion 13 is formed at the outermost periphery, and a rectangular plate portion 14 is formed at the innermost end. Portions painted out black in FIG. 1 are portions 15 of the circuit on the opposite side, which are viewed through the insulating film from non-circuit portions on the front side, while portions 16 are portions of non-circuit portions on the back side, which are hidden by the circuit portions on the front side. The number of turns of each coil is 2 to 12, preferably 5 to 10.

The coils formed on both sides are electrically connected to each other in the vicinity of ends of the respective circuits, for example, at the rectangular plate portions 14. The turning directions of both circuits must be reversed to each other when viewed from the same direction to the tag, in order that induced current in an electromagnetic field is not offset at both front and back sides. Both circuits are almost superimposed on each other except portions that cannot be superimposed on each other because the turning directions of the coils are reversed with the exception of the outermost peripheries when viewed from a direction perpendicular to the insulating film, thereby forming a capacitor to constitute an LC circuit as a whole. More specifically, when the turning directions of the coils are reversed, portions 15, 16 that the patterns on both sides are not superimposed on each other occur by any means at sites, at which the diameter of a coil is changed, and the like. Therefore, both patterns are formed in such a manner that they are superimposed on each other at the other portions thereof as much as possible. By doing so, the capacitance can be made larger to achieve the miniaturization of a tag.

No circuit is formed in the center of both coiled circuits. Accordingly, a closed plain portion 21 surrounded by the innermost peripheries of the coils formed on both sides of the insulating film and having no metal foil on both sides exists in the center of the tag as illustrated in FIG. 1. This portion will hereinafter be referred to as the opening part. The proportion (hereinafter referred to as "percent opening") of the opening part of each side of the tag occupied in the whole area of each side of the tag must be at least 16%. If the percent opening is lower than 16%, sufficient performance cannot be achieved in a resonant tag of at most 700 $mm^2$ in dimensions. The percent opening is preferably 16 to 50%, more preferably 19 to 50%.

Figure 4:
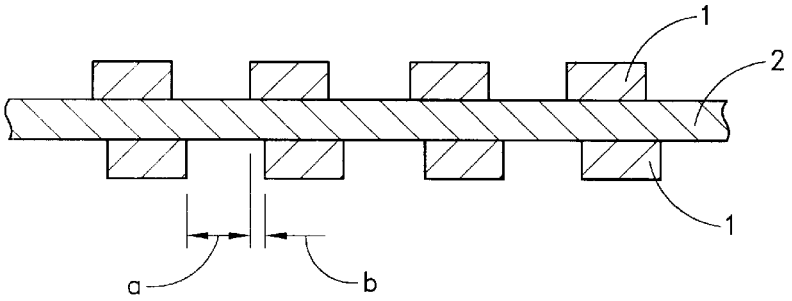
FIG. 4 schematically illustrates a section of the resonant tag according to the present invention.

In the present invention, most of the circuits formed on both sides are superimposed on each other, and the widths of portions of said both circuits, which correspond to each other, are almost equal except the outermost peripheries. However, portions that cannot be superimposed on each other by any means in part of the outermost peripheries of the coils or because the turning directions of the coils are reversed, and portions that are not superimposed on each other due to deviation in alignment when the patterns are formed are present. Therefore, the total area of the superimposed portions of the circuits on the front and back sides is preferably at least 72% based on the whole area of the circuits on said both sides. An average deviation between the patterns in the portions where the circuit patterns on both sides are superimposed on each other with the exception of the outermost peripheries is preferably at most 0.15 mm when viewed from a direction perpendicular to the thin film. FIG. 4 schematically illustrates a section of the resonant tag. Reference numerals 1 and 2 indicate a metal foil circuit and an insulating film, respectively. The deviation between the patterns means "b" shown in FIG. 4, and the average deviation means an arithmetic mean of a deviation in a longitudinal direction and a deviation in a cross direction. Only 0.10 mm has heretofore been allowed for the average deviation between the patterns. If the average deviation exceeds this limit, no sufficient signal intensity cannot be obtained. In the present invention, sufficient signal intensity can be obtained even when the average deviation is 0.15 mm by controlling the percent opening to the range described above, so that the width of allowability in pattern precision can be widened.

A line spacing in the coiled circuits on the front and back sides is preferably at most 400 $\mu$m. The line spacing in the coiled circuits on the front and back sides as used herein means "a" shown in FIG. 4 and not a line spacing in the circuit on one side. If the line spacing is greater than 400 $\mu$m, sufficient performance cannot be achieved in a resonant tag of at most 700 $mm^2$ in dimensions, particularly, a rectangular resonant tag of at most 23 mm×26 mm in dimensions. The line spacing is preferably 150 to 250 $\mu$m.

Figure 5:
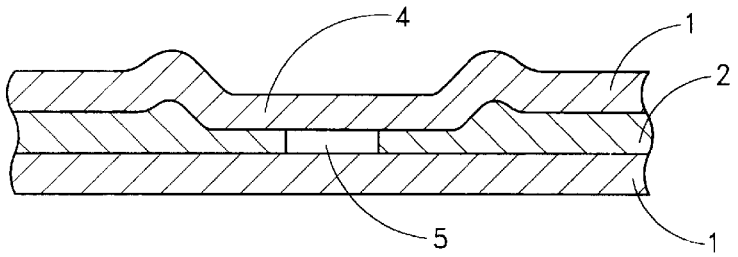
FIG. 5 illustrates a part of the resonant tag according to the present invention, at which dielectric breakdown is caused.

In part of the portions where the circuits on both sides are superimposed on each other, a thin-wall part where the thickness of its corresponding insulating film portion is thinner than that of its remaining portion is formed so as to undergo dielectric breakdown when applying a voltage thereto. For example, a recessed part 4 is provided in a part of the triangular plate portion which is a part of the circuit as illustrated in FIG. 5. The circumference of the recessed part 4 may be somewhat projected. A prescribed voltage is applied to this thin-wall part after the purchase of a product, thereby causing dielectric breakdown so as not to resonate with a wave of a prescribed radio frequency. A fine through hole is preferably provided in the thin-wall part, whereby dielectric breakdown is effected with ease and certainty.

In the resonant tags according to the present invention, an LC circuit is formed so as to resonate with a wave of the predetermined desired radio frequency. In order to do so, the thickness of the insulating film, the proportion occupied by the opening part, the number of turns in each coil, the width of each circuit and the degree of superimposition of circuits on both sides are suitably determined within the above-described respective ranges. As a resonant frequency, a frequency of 8.2 MHz and a frequency of 13.56 MHz are oftenest used in EAS (Electric Article Surveillance) and RFID (Radio Frequency Identification), respectively. When a product, to which a tag is attached, has an intrinsic capacitance in itself, the frequency property of the tag is determined so as to become the predetermined resonant frequency by interaction between the product and the tag. As examples of such a product, may be mentioned meat and the like.

An exemplary production process of the resonant tag according to the present invention will hereinafter be described.

The resonant tag according to the present invention can be produced by an etching process.

An electroconductive metal foil such as an aluminum foil is first laminated on both sides of an insulating film to form a desired pattern on both metal foils of the resultant laminate film with an etching resist. The printing of the etching resist can be conducted by using a printing system such as screen printing, rotary letterpress printing, flexographic printing, offset printing, photographic printing or gravure printing. The metal foils are etched to form metal foil circuits on both sides. The circuits on both sides are then electrically connected to each other by a publicly known method such as fusion bonding by cold welding, high frequency, ultrasonic wave or the like.

A thin-wall part is then formed at a part of the circuit, for example, a triangular plate portion. A fine through hole is preferably formed in this portion. The process of the formation of the thin-wall part is disclosed in Japanese patent laid open No. 91552/1997. For example, the portion to be thin-walled is heated and pressed at prescribed temperature and pressure. At this time, the temperature and pressure are suitably determined, thereby destroying a crystal structure of the insulating film at this portion to form a through hole.

The resonant tags according to the present invention feature that the amplitude at a peak upon resonance is as very great as at least 7.6 dB (at least GST 0.14 V) though they are small in size, so that its signal intensity is high. The resonant tags according to the present invention also feature that they resonate with only a wave of the predetermined resonant radio frequency and scarcely resonate with waves of other noise frequencies though they are small in size, they are of so-called erasing type that they come to have no determined resonant frequency by applying a certain voltage thereto, the performance is scarcely lowered by a deviation in superimposition of patterns, and the thickness of the metal foils can be reduced.

The resonant tags according to the present invention are used by being attached to products. If a product attached with a resonant tag, which is subjected to no dielectric breakdown treatment, passes through between a pair of antennas which is installed in an exit of a store or the like and transmit and receive a wave of the prescribed radio frequency, respectively, the receiving part detects a radio-frequency wave resonated with the radio-frequency wave transmitted from the transmitting part to give an alarm. The transmission and reception of the radio-frequency wave may be conducted either by left and right different antennas or by the same antennas. When the transmission and reception are conducted by the different antennas, the sensitivity may be lowered in some cases when the product passes through a position farther from the transmitting antenna, i.e., a position nearer the receiving antenna. When the transmission and reception are conducted by a pair of the same antennas, a distance from the left and right transmitting parts is a half of a distance between the antennas in the longest, so that the sensitivity is improved. In this case, the transmission and reception are alternately conducted at an extremely short cycle by the same antennas.

The present invention will hereinafter be described by the following Examples. Incidentally, the magnitude of an amplitude in each resonant tag sample was evaluated in accordance with the following method.

Figure 6:
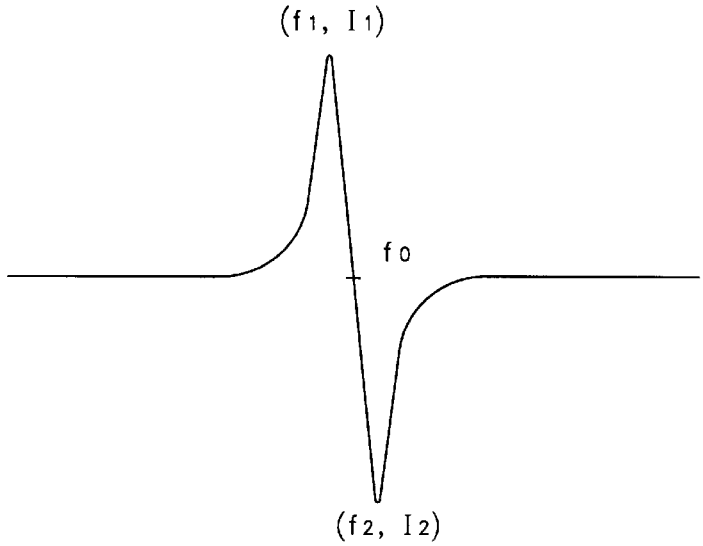
FIG. 6 illustrates a spectrum obtained by determining the resonant property of the resonant tag by means of a network analyzer or spectrum analyzer.

A tag sample was set in a measuring coil (Helmholts coil) composed of a transmitter and a receiver so as not to protrude from the coil to measure the intensity of a signal from the tag as an amplitude by means of a network analyzer or spectrum analyzer, thereby obtaining a spectrum as illustrated in FIG. 6. The magnitude of the amplitude is expressed by $I_1$–$I_2$ (dB) or GST. GST is a value obtained by converting the intensity of a signal received by the receiver to a voltage value (V) using a multimeter.

EXAMPLE 1

Patterns illustrated in FIGS. 2 and 3 were respectively printed by screen printing with an etching resist on both side of a laminate film obtained by laminating an aluminum foil having a thickness of 50 $\mu$m on both sides of a polyethylene film having a thickness of 20 $\mu$m. At this time, alignment was conducted in such a manner that the circuit patterns on both sides conform to each other as much as possible. The aluminum foils on both sides were etched with ferric chloride to form respective circuits. Part of plate portions located at the innermost ends of the circuits were pressed from both sides, thereby partially destroying the polyethylene film and at the same time interlocking the aluminum foils on both sides with each other to electrically connect both circuits to each other. Triangular plate portions were heated and pressed to form a recessed part therein and form a fine through hole in the polyethylene film. The thus-treated laminate film was lastly cut into a prescribed size to obtain a rectangular resonant tag of 23 mm×26 mm in dimensions. The items and performance of this tag are shown in Table 1.

Comparative Example 1

Figure 7:
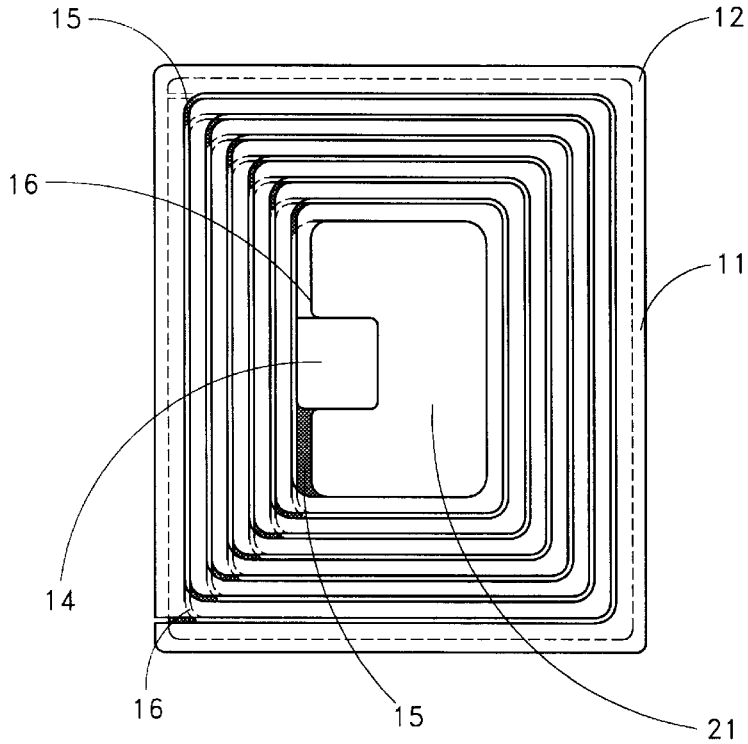
FIG. 7 illustrates an exemplary resonant tag which does not belong to the present invention as viewed from its one side.
Figure 8:
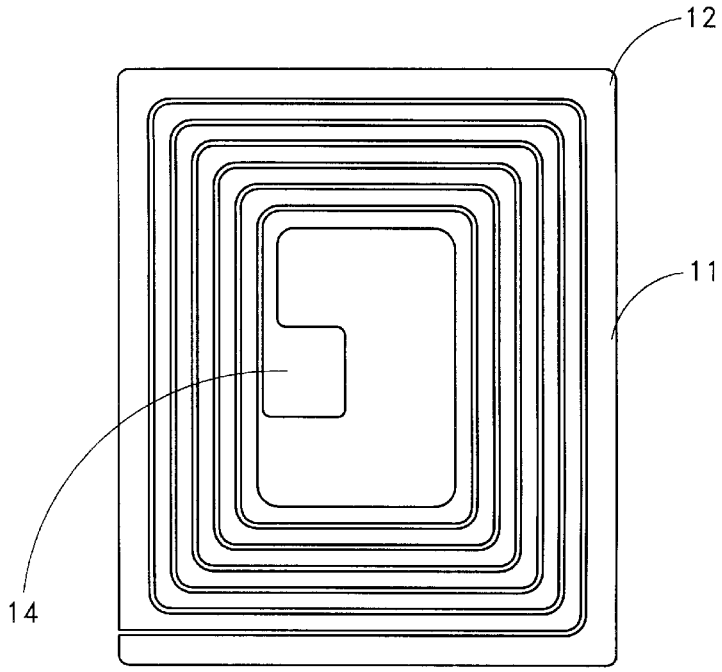
FIG. 8 illustrates a circuit pattern on one side of the resonant tag shown in FIG. 7.
Figure 9:
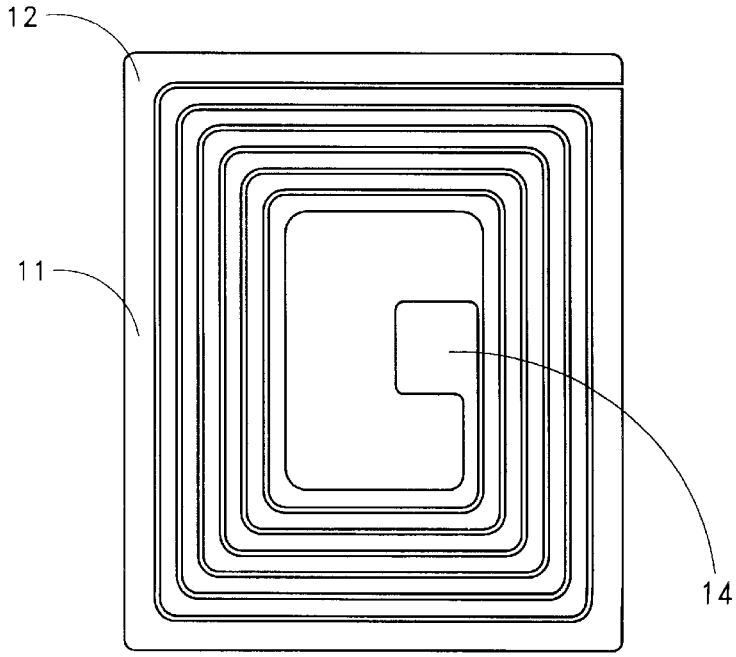
FIG. 9 illustrates a circuit pattern on the other side of the resonant tag shown in FIG. 7.

Patterns illustrated in FIGS. 8 and 9 were respectively printed by screen printing with an etching resist on both side of a laminate film obtained by laminating an aluminum foil having a thickness of 50 $\mu$m on both sides of a polyethylene film having a thickness of 20 $\mu$m. FIG. 7 illustrates the thus-obtained patterns when viewed from the front side. Thereafter, the thus-treated laminate film was treated in the same manner as in Example 1, thereby obtaining a rectangular resonant tag of 23 mm×26 mm in dimensions. The items and performance of this tag are shown in Table 1.

TABLE 1

| | Percent opening (%) | Proportion of superimposed portions of patterns (%) | Average deviation between patterns (mm) | Line spacing in circuit ($\mu$m) | Amplitude (dB) |
|---|---|---|---|---|---|
| Ex. 1 | 19.9 | 86.9 | 0.04 | 230 | 8.1 |
| Comp. Ex. 1 | 14.2 | 88.0 | 0.03 | 230 | 6.3 |

The practical magnitude of an amplitude is at least 7.6 dB. It is thus understood that the amplitude of the tag according to Example 1 is 8.1 dB, and so the tag has sufficient practicability. On the other hand, the amplitude of the tag according to Comparative Example 1 was 6.3 dB, and so the tag was insufficient as a monitoring tag.

EXAMPLE 2

Figure 10:
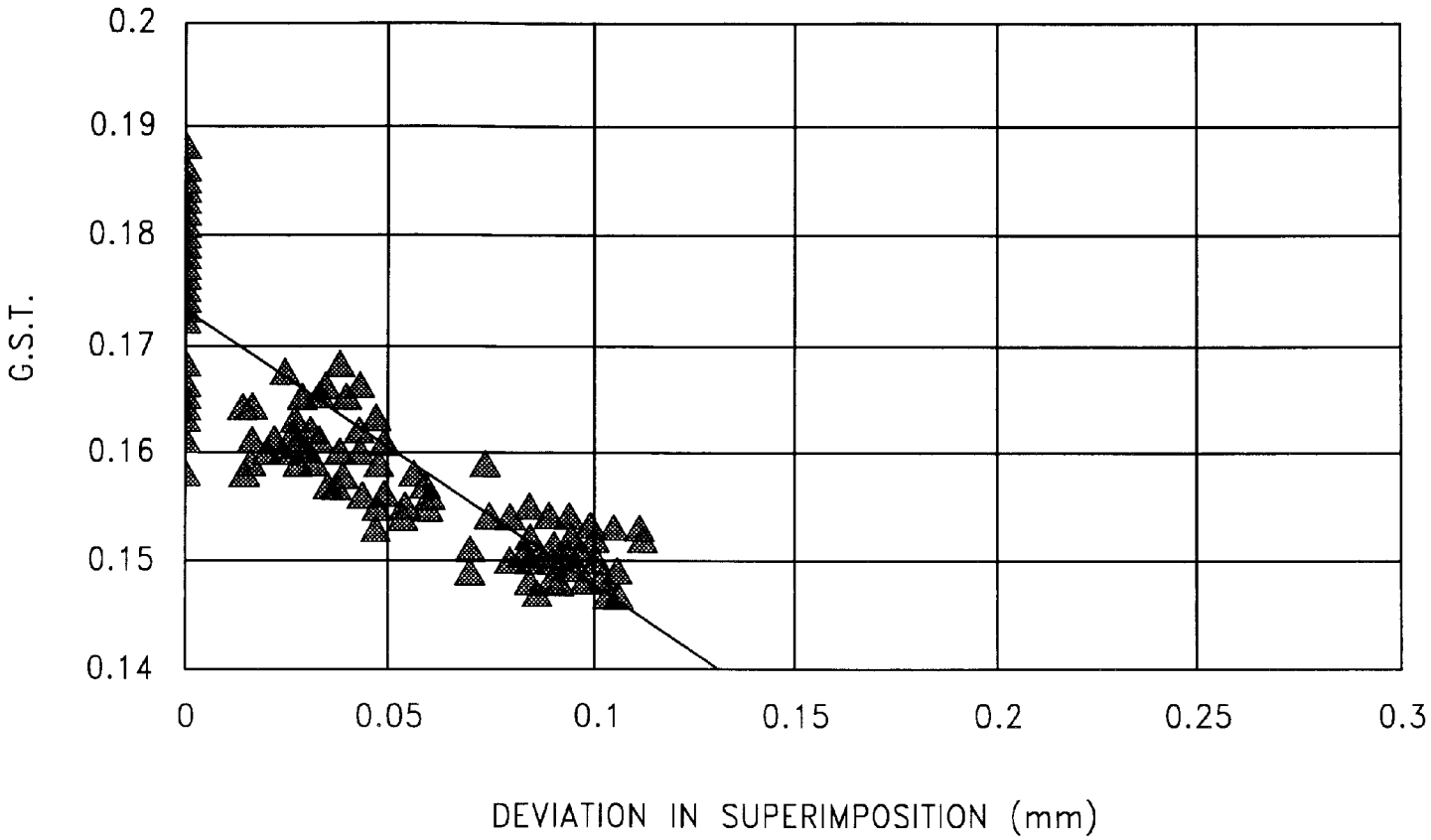
FIG. 10 diagrammatically illustrates the relationship between a deviation in superimposition of patterns and GST.

A great number of rectangular resonant tags of 23 mm×26 mm in dimensions were produced in the same manner as in Example 1 except that alignment was not strictly conducted, thereby determining a deviation in superimposition of patterns and GST. The results are diagrammatically illustrated in FIG. 10. When the magnitude of amplitude is expressed by GST, it is preferably at least 0.14 V from the viewpoint of practicability. It is understood from FIG. 10 that when the deviation in superimposition of patterns is at most 0.15 mm on the average, sufficient performance is achieved.

EXAMPLES 3 and 4 and Comparative Example 2

Rectangular resonant tags of 23 mm×26 mm in dimensions were produced in a similar manner to Example 1 except that the items were respectively changed as shown in Table 2, thereby determining their performance in the same manner as in Example 1. The results are shown in Table 2.

It is understood from Table 2 that when the percent opening is at least 16%, excellent performance is achieved.

TABLE 2

| | Percent opening (%) | Proportion of superimposed portions of patterns (%) | Average deviation between patterns (mm) | Line spacing in circuit (μm) | Amplitude (dB) |
|---|---|---|---|---|---|
| Comp. Ex. 2 | 15.4 | 90.8 | 0.03 | 150 | 7.50 |
| Ex. 3 | 17.6 | 91.2 | 0.02 | 150 | 7.77 |
| Ex. 4 | 19.7 | 90.0 | 0.03 | 150 | 8.04 |

As described above, the resonant tags according to the present invention have a great amplitude when they resonate with a wave of a radio frequency though they are small in size compared with the conventional tags, so that they have excellent sensitivity. Accordingly, they are easy to be attached to various products and particularly suitable for use as monitoring tags for small-sized products such as cosmetics and jewelry.

What is claimed is:

1. A resonant tag comprising an insulating thin film having a thickness of 10 to 30 μm, and coiled circuits made of a metal foil respectively formed on both sides of the insulating thin film, wherein the coiled circuits are formed in an electrically connected relation to each other with a space at the center of the insulating thin film, said both coils are formed taking turns in reverse directions to each other when viewed from the same direction and almost superimposed on each other except portions that cannot be superimposed on each other because the turning directions of the coils are reversed with the exception of the outermost peripheries when viewed from a direction perpendicular to the thin film, thereby forming a capacitor to constitute an LC circuit, the widths of portions of said both circuits, which correspond to each other, are almost equal except the outermost peripheries, the area of a portion of each side of the thin film, said portion being surrounded by the innermost peripheries of both coils and having no metal foil on both sides, is at least 16% based on the whole area of said one side of the tag, a thin-wall part where the thickness of its corresponding insulating film portion is thinner than that of its remaining portion is formed in part of the portions where said both circuits are superimposed on each other, the resonant tag resonates with a wave of the predetermined radio frequency and undergoes dielectric breakdown at the thin-wall part when applying the prescribed voltage or higher voltage to the tag, whereby the resonant tag can be prevented from resonating with the wave of said radio frequency, and the resonant tag has an area of at most 700 $mm^2$.

2. The resonant tag according to claim 1, which is in the form of a rectangle (including a square) of at most 25 mm×28 mm in external dimensions.

3. The resonant tag according to claim 2, wherein the external dimensions are at most 23 mm×26 mm.

4. The resonant tag according to claim 1, wherein the total area of the superimposed portions of said both coiled circuit patterns is at least 72% based on the whole area of the circuits on said both sides.

5. The resonant tag according to claim 1, wherein an average deviation between the superimposed portions of said both coiled circuit patterns is at most 0.15 mm.

6. The resonant tag according to claim 1, wherein a line spacing in said both coiled circuit patterns is at most 400 μm.

7. The resonant tag according to claim 1, wherein the area of a portion of each side of the thin film, said portion being surrounded by the innermost peripheries of both coils and having no metal foil on both sides, is 16 to 50% based on the whole area of said one side of the tag.

8. The resonant tag according to claim 1, wherein the thickness of the metal foil is 30 to 80 μm.

9. The resonant tag according to claim 1, wherein a crystal structure of the insulating film is destroyed at the thin-wall part to form a through hole therein.

10. The resonant tag according to claim 1, wherein the predetermined resonant frequency is 5 to 15 MHz.

11. The resonant tag according to claim 10, wherein the predetermined resonant frequency is 8.2 MHz.

12. The resonant tag according to claim 10, wherein the predetermined resonant frequency is 13.56 MHz.

13. The resonant tag according to claim 1, wherein the initial frequency of the tag is determined so as to resonate with the predetermined resonant frequency by its interaction with the intrinsic capacitance of a product when the tag is attached to the product.

14. The resonant tag according to claim 1, wherein the number of turns of the coiled circuits is 2 to 12.

15. The resonant tag according to claim 1, wherein said both circuits are electrically connected to each other at the innermost ends thereof.

16. The resonant tag according to claim 1, wherein said both circuits each have a triangular plate portion at a part of the outermost periphery thereof.

17. The resonant tag according to claim 1, wherein the coils each have a rectangular plate at the innermost end thereof and are electrically connected to each other at the plate portions thereof.

18. A resonant tag comprising an insulating thin film having a thickness of 10 to 30 μm, and coiled circuits made of a metal foil respectively formed on both sides of the insulating thin film, wherein the coiled circuits are each composed of linear portions, curved portions for connecting the linear portions to each other, a triangular plate portion formed at a part of the outermost periphery of the coil, and a rectangular plate portion formed at the innermost end of the coil, the number of turns of said coil being 2 to 12, and are formed in an electrically connected relation to each other at the innermost plate portions with a space at the center of the insulating thin film, said both coils are formed taking turns in reverse directions to each other when viewed from the same direction and superimposed on each other except portions that cannot be superimposed on each other because the turning directions of the coils are reversed with the exception of the outermost peripheries when viewed from a direction perpendicular to the thin film, thereby forming a capacitor to constitute an LC circuit, the widths of portions of said both circuits, which correspond to each other, are almost equal except the outermost peripheries, the area of a portion of each side of the thin film, said portion being surrounded by the innermost peripheries of both coils and having no metal foil on both sides, is 16 to 50% based on the whole area of said one side of the tag, the total area of the superimposed portions of said both coiled circuits is at least 72% based on the whole area of the circuits on said both sides, an average deviation between the superimposed portions of said both coiled circuit patterns is at most 0.15 mm, a line spacing in said both coiled circuits is at most 400 $\mu$m, a thin-wall part where the thickness of its corresponding insulating film portion is thinner than that of its remaining portion is formed in the triangular plate portion, the resonant tag resonates with a wave of the predetermined radio frequency and undergoes dielectric breakdown at the thin-wall part when applying the prescribed voltage or higher voltage to the tag, whereby the resonant tag can be prevented from resonating with the wave of said radio frequency, and the resonant tag is in the form of a rectangle (including a square) of at most 25 mm×28 mm in external dimensions.

19. An apparatus for detecting products, which comprises a pair of antennas respectively transmitting and receiving a wave of a radio frequency, and the resonant tag according to claim 1.

20. The detecting apparatus according to claim 19, wherein the transmission and reception of the radio-frequency wave are conducted by separate transmit and receive antennas.

21. The detecting apparatus according to claim 19, wherein the transmission and reception of the radio-frequency wave are conducted by the same antennas.

* * * * *